United States Patent [19]

Mazzorana

[11] 4,262,546

[45] Apr. 21, 1981

[54] STARTER MOTOR FOR AN INTERNAL COMBUSTION ENGINE

[75] Inventor: Alfred B. Mazzorana, Venissieux, France

[73] Assignee: Societe de Paris et de Rhone, Lyons, France

[21] Appl. No.: 935,139

[22] Filed: Aug. 21, 1978

[30] Foreign Application Priority Data

Sep. 15, 1977 [FR] France ..... 77 28531

[51] Int. Cl.[3] ..... F02N 11/08

[52] U.S. Cl. ..... 74/7 A

[58] Field of Search ..... 74/7 A, 7 R, 6

[56] References Cited

U.S. PATENT DOCUMENTS

| | | | |
|---|---|---|---|
| 3,177,728 | 4/1965 | Farison | 74/7 A |
| 3,223,863 | 12/1965 | Preece et al. | 74/7 A |
| 3,304,790 | 2/1967 | Takami | 74/6 |
| 3,866,960 | 2/1975 | Chohan | 74/6 |
| 4,116,077 | 9/1978 | Mazzorana | 74/7 A |

FOREIGN PATENT DOCUMENTS

| | | | |
|---|---|---|---|
| 1944721 | 5/1970 | Fed. Rep. of Germany | 74/7 A |
| 2727888 | 12/1977 | Fed. Rep. of Germany | 74/7 A |

*Primary Examiner*—Werner H. Schroeder

*Attorney, Agent, or Firm*—Browdy and Neimark

[57] ABSTRACT

A starter motor for an internal combustion engine has an electromagnetic switch (11) and a "tooth against tooth" safety spring (37) to deform to allow the switch core (14) to move into a switch closing position even if the teeth on the starter pinion (10) and the starter ring gear of the engine are coincident rather than meshing as the pinion (10) contacts the starter ring gear. The "tooth against tooth" spring is a leaf-spring (37) serving as a yieldable fulcrum for the yoke, and the moving core (14) of the switch accommodates slidably a contact-bearing rod (15) of the switch which rod also passes slidably through the fixed core (13) of the switch.

At its end remote from the contact, the rod (15) engages a yieldable stop (34) which biases the rod towards a "contact closing" position. The fixed core is thus devoid of a contact-closing spring and has a more massive flux path than it would otherwise do.

10 Claims, 4 Drawing Figures

STARTER MOTOR FOR AN INTERNAL COMBUSTION ENGINE

DESCRIPTION

The present invention relates to a starter motor for an internal combustion engine.

In order to clarify the following text, the importance of this helically splined system will now be outlined with particular reference to the "tooth against tooth" phenomenon, that is to say to the fact that the teeth on the pinion which is joined to the drive device via a gear carrier, may not be in a suitable position, relative to the teeth on the ring gear, to engage with the latter when the starter motor is powered. In order to resolve this difficulty, the moving core of the switch is allowed to move until it comes to rest against the fixed core, whilst compressing a so-called "tooth against tooth" or "safety" spring which stores energy and, by subsequently being released, enables the teeth on the pinion to engage with those on the ring gear as soon as rotation of the starter pinion has made this possible. This "tooth against tooth" spring is usually situated on the pinion drive device; in prior art, it has also been situated in the region of the switch and more particularly in the moving core as described, for example, in our French Patent No. 1,570,596. In our said Patent, the rod connecting the yoke to the moving contact is mounted so as the slide in the said moving contact, with the interposition of a spring which acts as a "tooth against tooth" spring. With helical grooves, a very slight engagement of the teeth on the pinion between those on the ring gear is sufficient because, under the action of the resisting torque of the internal combustion engine and the reaction on the helical splines, the pinion will move in an axial direction, further into engagement, until fully engaged with the ring gear where it is brought to rest, in the axial direction, by means of a stop on the armature shaft. From this moment the starter motor is capable of transmitting a torque and a rotational speed to the ring gear. The helical splines therefore make is possible to save energy and it can be noted that, as soon as the starter motor rotates, the initial force which served to compress the "tooth against tooth" spring is no longer required at the same magnitude from the switch solenoid. For this reason as soon as the main contact which feeds the starter motor windings is closed, the so-called "pull-in" winding of the switch mechanism, which exerts the greatest attractive force on the moving core, is disconnected and connection is only maintained to the so-called "holding" winding which consumes 5 to 6 times less current and will be adequate to hold the core in position through the entire starting period by virtue of the action of the helical splines as has been explained above. As soon as the engine fires, the increase in the rotational speed causes the pinion to return to its rest position, by means of the conjugate action of the helical splines and by virtue of the inertia and friction of the armature assembly.

In starter motors of the general kind considered in this case, the moving contact is generally mounted so as to slide on a moving rod, referred to as a "contact-bearing rod", which rod is connected to the moving core of the switch mechanism and passes through the fixed core, with the interposition of a spring which presses the moving contact against the fixed contact, in order to absorb the variations in position of the contact-bearing rod when the latter is acted upon by the moving core which "clings" to the fixed core. The fitting of this equaliser spring requires the provision of an adequate housing in the fixed core, the existence of which housing causes a considerable decrease in the cross-section of the core for the circulation of the magnetic flux. In present-day starter motors, it is noted that the loss of ampere-turns is greatest in this region.

According to the present invention there is provided a starter motor for an internal combustion engine, comprising an electromagnetic switch whose moving contact consists of a moving core and a contact-bearing rod and is coupled to a yoke joined to the drive device of the starter pinion, the said drive device having internal helical splines which engage with helical splines formed on the armature shaft of the motor, a contact spring being housed in a recess in the moving core of the switch at the one end of this core at which the yoke is coupled, said contact-bearing rod being slidably mounted within a bore in the said moving core, and the said bore opening into the said recess. The contact spring advantageously rests against the base of a hook for coupling the yoke, which base closes the abovementioned recess.

This arrangement no longer makes it possible to house additionally the "tooth against tooth" spring in the moving core, according to a known arrangement referred to above. In order to avoid this difficulty and also as shown later to be advantageous in other ways it is proposed that the "tooth against tooth" spring be in the form of a leaf-spring mounted on a fixed element of the starter motor and also serving as an intermediate fulcrum for the yoke, the yoke thus having no intermediate axis of articulation, and the said spring being prestressed so that it only begins to yield under a given force. In this case, the yoke is therefore of unusual construction, where usually the yoke consists of a rigid lever articulated at an intermediate point about a fixed axis.

In the rest position a running clearance is preferably provided between the yoke and the abovementioned leaf-spring so that in this rest position the contacts and supports provided are well assured, either at the level of the yoke and the pinion or at the level of the moving core.

The main advantages gained by the characteristics stated above are as follows:

The location of the contact spring in the moving core makes it possible, without increase in bulk, to avoid the constriction of the magnetic flux in the fixed core.

The omission of the intermediate axis for the pivoting of the yoke simplifies, and reduces the costs of, manufacture more especially as the "tooth against tooth" spring performs a dual function in this case.

Furthermore, the arrangement which is preferably chosen, in which there is a running clearance in the rest position between the yoke and this "tooth against tooth" spring, makes it possible to hold the moving core more effectively in the rest position.

In order that the invention may more readily be understood the following description is given, merely by way of example, with reference to the accompanying simplified drawings, in which.

Figure 1:
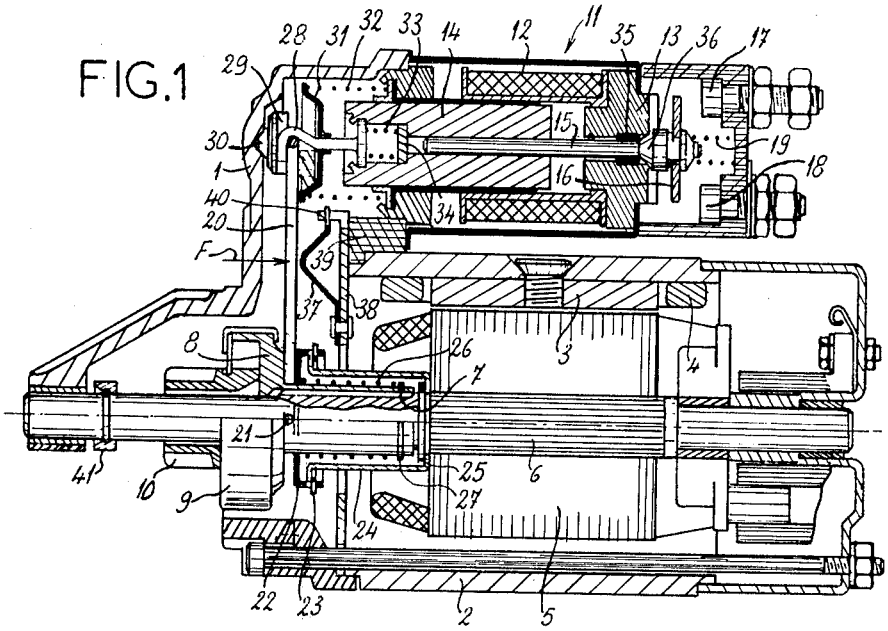
FIG. 1 is a view, in longitudinal section, of a starter motor for an internal combustion engine, according to the invention.

The drawings, and especially FIG. 1, shows the conventional main components of a starter motor, namely a housing 1 into which is inserted the casing 2 supporting the poles 3 of a stator, which are surrounded by exciter windings 4, and a rotor or armature 5 which is integral with a shaft 6. This shaft 6 has helical splines 7 which engage with complementary internal helical splines formed on the drive device 8, which is connected to the pinion 10, by a gear carrier sleeve 9 which can engage with a toothed ring gear (not shown) of the engine. The supply to the motor windings is controlled by means of an electromagnetic switch 11 fixed to the housing 1. The switch 11 comprises, windings 12 (including a fixed pull-in winding and a holding winding), a fixed core 13 and a moving contact consisting of a moving core 14, a rod 15 which passes through both the fixed core 13 and the moving core 14 through which it can slide, and a moving contact 16 which is carried by the rod 15 and makes it possible to establish an electrical current between two fixed contacts 17 and 18, the starter motor windings being fed via these contacts. The moving contact 16 is electrically insulated from the rod 15 if the latter is made of metal. The contact-bearing rod 15 is normally kept in the open-contact position by means of a spring 19. Furthermore, the switch 11 ensures the axial movement of the drive device 8 of the pinion by means of a lever 20, also called a yoke, which is joined, both to the moving contact of the switch and to the drive device 8 of the pinion and is supportd at an intermediate fulcrum point.

Figure 2:
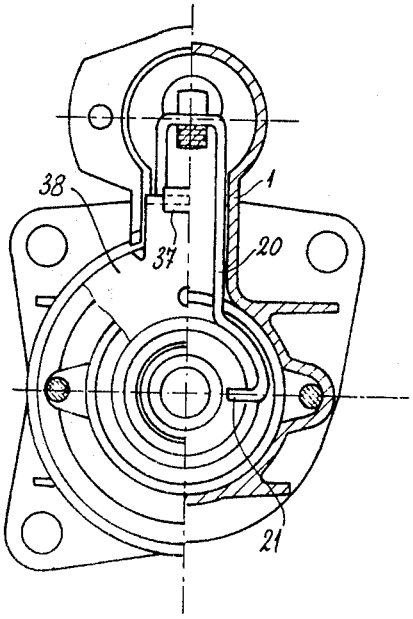
FIG. 2 is an end view, in partial section of the motor of FIG. 1.
Figure 3:
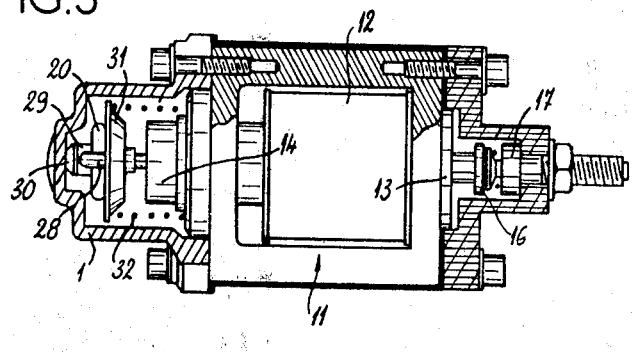
FIG. 3 is a detail, in partial section, of this starter motor showing the region of the switch.

The yoke 20 does not consist of a lever mounted so as to pivot about a fixed axis, but consists of a simple member which comprises two prongs and has a front elevation shown in FIG. 2. Near the driver device 8, the ends 21 of the two prongs of the yoke 20 are bent so as to turn towards one another and, in the rest position, they are elastically squeezed between the body of the drive device 8 and a stamped cap 22. This cap has a cylindrical skirt provided with two diametrically opposed apertures in which are engaged lugs formed on an elastic retaining ring 23 which locates one end of a case 24 which in turn encloses the helically splined shaft 6 and drive device 8 and which is coaxial with the shaft and the drive device. The other end of the case 24 is axially located between the bundle of laminations of the rotor 5 and a circlip 25 carried by the shaft 6. A helical pinion return spring 26 is mounted around the splined cylindrical section of the drive device and is enclosed by the case 24. This return spring is compressed and presses both against the cap 22, and against another circlip 27 mounted on the cylindrical section of the drive device. FIG. 1 shows all these components at rest, in which position they constitute an anti-vibration system.

Near the switch 11, the yoke 20 is coupled to a hook 28, the base of which is crimped onto the moving core 14, and a coupling member 29 with a pointed extension 30 is also provided. A cap 31 is mounted on the rod of the hook 28 and serves as an abutment for the helical return spring 32 of the moving core 14. In the rest position this return spring 32 holds the pointed extension 30 of the coupling piece 29 in a complementary conical recess formed on the housing 1.

The moving core 14 has at the end remote from the moving contact 16 a recess which is closed by the base of the coupling hook 28 and in which is housed a spring 33 for pressing the moving contact, said spring abutting both the said base and an elastic stop 34 which, in the rest position, it holds on the bottom of the said recess.

The elastic stop co-operates with the end of the contact-bearing rod 15, the said rod being mounted so as to slide inside a bore in the moving core 14, when the moving core 14 is attracted towards the fixed core 13 in order to keep the moving contact 16 pressed against the fixed contacts 17 and 18, the said bore opening out at the bottom of the said recess. It should be noted that, in this case, the contact-bearing rod 15 is made of a non-magnetic material which is as light as possible and that, when passing through the fixed core 13, it is guided in a plastic sleeve 35 which damps vibrations. This anti-vibration device is completed by a support with a conical bearing 36 on the contact-bearing rod 15, which mates with a complementary conical flared part in the fixed core 13.

Finally, in the intermediate part of the yoke 20, a device is provided which serves both as a fulcrum for this yoke and as a "tooth against tooth" spring. This device consists of a shaped leaf-spring 37 riveted on a plate 38 which being located between the housing 1 and the motor casing 2 serves to locate a gasket 39. The plate 38 is extended, in an upward direction (as viewed in FIG. 1), by a lug which is bent at right angles forming a free end 40 in which there is an aperture receiving the end tab of the spring 37. This device enables a pre-stress to be imparted to the spring 37, so that it only begins to yield under a given force F.

It will be noted that, in the rest position, there is a clearance between the yoke 20 and the spring 37, as shown in FIG. 1, so that the yoke is not supported at an intermediate point. Thus good contact is maintained between the yoke and both the pinion drive device 8 and the moving core 14.

The operation of the motor is described below, with reference to FIG. 1:

In a first and simplest case, the "tooth against tooth" phenomenon is taken not to occur at the initial contact between the teeth of the starter pinion 10 and the ring gear. Firstly the ignition key of the vehicle is operated. This energises the pull-in winding of the switch 11 and causes an initial movement of the moving core 14. The said core moves until the yoke 20, after having pivoted slightly about is fulcrum on the drive device 8 of the pinion, has taken up the clearance which separates it from the leaf-spring 37. During this first stage, there is no axial movement of the pinion 10.

During a second stage, the yoke 20 rests on the spring 37 whose resistance is chosen to be greater than the force required for the pinion 10 to penetrate into the ring gear. The moving core 14 continues its stroke towards the fixed core 13, the yoke 20 pivots about its support on the spring 37, and the teeth on the pinion 10 engage with the teeth on the ring gear. Simultaneously, the moving core 14 pushes back the contact-bearing rod 15, the spring 33 for pressing the moving contact being chosen so as to offer a greater force than that of the release spring 19 in its most compressed position. Electrical contact is established to power the motor windings and hence cause the armature with its shaft 6 to rotate. The pull-in winding is cut off and only the holding winding is fed, the action of the helical splines 7 being such that the switch mechanism 11 only needs to provide a small holding force. Finally, the moving core 14 comes to rest against the fixed core 13 and, in this end-of-stroke position, the spring 33 becomes compressed so as to exert a pressure on the contact 16 and the yoke 20 reaches a final position.

In a third stage of the operation of yoke movement, the pinion 10 continues to move forward axially under the action of the helical splines until abutting stop 41 formed by a ring carried by the shaft 6, the yoke 20 remaining in its final position reached before the pinion return spring 26 is then fully compressed between the cap 22 and the circlip 27.

Finally, in a fourth and final stage, the internal combustion engine has been set in self-powered motion and the ignition key is released so as to break the connection to the windings 12 of the switch 11. The moving core 14 returns to its initial rest position, firstly under the conjugate action of the release spring 19 and the return spring 32, and then under the action of the return spring 32 alone, the spring 33 also acting in an auxiliary capacity to move the core to its original position. The starter motor windings are no longer powered and the pinion 10 is returned to its rest position due both to the "screwing-up" effect of the helical splines in conjunction with the inertia of the armature, and the force applied by the return spring 26.

In a second case of operation the "tooth against tooth" phenomenon is taken to occur between the teeth of the ring gear and the starter pinion 10. In this case, the functioning differs from that described above only in the manner in which the teeth on the pinion 10 penetrate between those on the ring gear.

The first stage is strictly identical to the case described above.

During the second stage, the yoke 20 pivots about the spring 37 on which it rests, and the pinion 10 is pushed towards its stop 41 just until its teeth encounter the teeth on the ring gear, on which the pinion is brought to rest.

In the following stage, with the switch 11 continuing to pull the yoke 20, the spring 37 collapses under the action of a force greater than the value F and enables the moving core 14, which is pushing the rod 15, to bring the moving contact 16 against the fixed contacts 17 and 18. Almost simultaneously, (and after a very short time to allow the inertias to come into play), the pinion 10 begins to rotate, the spring 37 expands and the teeth on the pinion 10 engage with the teeth on the ring gear. It should be noted that in this case a very slight initial penetration of the teeth is sufficient to allow the helical splines to fulfil their function and this is moreover required in order to cut off the pull-in winding.

Thereafter, the third stage of the case described above remains the same and the fourth stage obviously remains unchanged.

Figure 4:
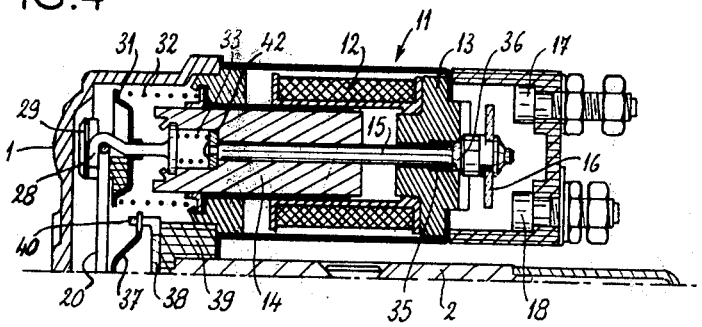
FIG. 4 is a detail, in longitudinal section, of a variant of this starter motor which is similar to FIG. 1.

It can be seen that the mode of operation described above, which utilises to the maximum extent the axial drive effect of the helical splines, makes it possible to standardize the stroke of the moving contact of the switch which, in this case, is not directly related to the initial distance between the pinion and the ring gear or therefore to the axial movement of the pinion. It is thus possible to accept that, in a variant which is otherwise dependent on the same principles of production and is illustrated in FIG. 4, the moving contact 16 can be joined more directly to the moving core 14, making it possible to omit the release spring 19. In this variant, the contact-bearing rod 15 carries, at its end which is opposite the contact 16, a stop washer 42 which is held, for example, by riveting and is housed inside the recess which contains the spring 33 for pressing the moving contact. This latter spring, which rests on the washer 42, can be made weaker because it no longer has to overcome the release spring 19, which has been omitted, its function being performed by return spring 32.

In view of the fact that in this case the connection between the moving core 14 and the contact-bearing rod 15 has been made by means of the stop washer 42, and provided that the conical recess 36, which supports the rod 15 on the fixed core 13 is retained as shown in FIG. 4, the pointed extension 30 of the coupling piece 29 and the complementary conical recess on the housing 1 can be omitted because the fixed rod 15 itself secures the moving core 14. Conversely, it is also possible to retain the pointed extension 30 which supports the moving core 14 on the housing 1, and to omit the conical recess 36, which supports the contact-bearing rod 15 on the fixed core 13; this latter possibility is not shown but can easily be envisaged.

I claim:

1. A starter motor for an internal combustion engine, comprising an electromagnetic switch whose moving contact consists of a moving core having a bore therein and a contact-bearing rod having at least one contact at one end thereof, said switch being coupled to a yoke joined to the drive device of the starter pinion, said drive device having internal helical splines which engage with helical splines formed on the armature shaft of the motor, a contact spring housed in a recess in said moving core of said switch at one end of this core at which said yoke is coupled, said contact spring being positioned to act on said contact-bearing rod at its end remote from said one end, said contact-bearing rod being slidably mounted within said bore in said bore opening into said recess.

2. A starter motor according to claim 1, wherein the contact spring abuts against the base of a hook coupled to said yoke, the said base closing the said recess.

3. A starter motor according to claim 1 or 2, wherein said contact spring abuts an elastic stop to hold said stop on the bottom of the said recess in the rest position of the switch, the said elastic stop engaging one end of the contact-bearing rod to bias the moving contact towards a "contact-made" position.

4. A starter motor according to claim 1 or 2, wherein the contact spring abuts a washer which is mounted in the same recess and is integral with one end of the contact-bearing rod.

5. A starter motor according to claim 1 or 2, and including means for coupling the yoke to the moving core, the said means having a pointed extension which, in the rest position, is supported in a complementary conical recess formed on the housing of the starter motor.

6. A starter motor according to claim 1 or 2, wherein said contact-bearing rod has a conical support portion which mates with a complementary conical flared recess in the fixed core of the switch.

7. A starter motor according to claim 1 or 2, including a leaf-spring mounted on a fixed element of the starter motor to serve as an intermediate fulcrum for the yoke, the yoke thus having no intermediate axis of articulation, and the said spring being pre-stressed so that it only begins to yield under a given force.

8. A starter motor according to claim 7, wherein, in the rest position of the switch, a running clearance is provided between the yoke and the said leaf-spring.

9. A starter motor according to claim 7 or 8, wherein the abovementioned "tooth against tooth" leaf-spring is fixed on a plate which is located between the cover of the starter motor and the casing supporting the stator of the motor.

10. A starter motor according to claim 9, wherein said plate is extended by a lug whose free end is bent at right angles, and in which there is an aperture which locates an end tab of the said leaf-spring.

* * * * *